US009035738B2

(12) United States Patent
Lee et al.

(10) Patent No.: US 9,035,738 B2
(45) Date of Patent: May 19, 2015

(54) MULTILAYER INDUCTOR AND METHOD FOR MANUFACTURING THE SAME

(71) Applicant: Samsung Electro-Mechanics Co., Ltd., Suwon-si, Gyeonggi-do (KR)

(72) Inventors: Sa Yong Lee, Suwon-si (KR); Jin Young Kim, Suwon-si (KR); Keun Yong Lee, Suwon-si (KR); Geum Hee Yun, Suwon-si (KR); Moon Soo Park, Suwon-si (KR)

(73) Assignee: Samsung Electro-Mechanics Co., Ltd., Suwon, Gyeonggi-Do (KR)

( * ) Notice: Subject to any disclaimer, the term of this patent is extended or adjusted under 35 U.S.C. 154(b) by 38 days.

(21) Appl. No.: 13/842,187

(22) Filed: Mar. 15, 2013

(65) Prior Publication Data

US 2014/0145812 A1 May 29, 2014

(30) Foreign Application Priority Data

Nov. 23, 2012 (KR) ..... 10-2012-0133666

(51) Int. Cl.

| | |
|---|---|
| ***H01F 5/00*** | (2006.01) |
| ***H01F 27/28*** | (2006.01) |
| ***H01F 17/00*** | (2006.01) |
| ***H01F 41/04*** | (2006.01) |
| *H01F 17/04* | (2006.01) |

(52) U.S. Cl.

CPC ..... *H01F 17/0013* (2013.01); *H01F 41/041* (2013.01); *H01F 41/046* (2013.01); *H01F 2017/048* (2013.01)

(58) Field of Classification Search

USPC ..... 336/200, 232

See application file for complete search history.

(56) References Cited

U.S. PATENT DOCUMENTS

| | | | | |
|---|---|---|---|---|
| 2010/0253464 | A1* | 10/2010 | Miyoshi et al. | 336/200 |
| 2010/0315191 | A1* | 12/2010 | Xiao et al. | 336/200 |
| 2012/0119863 | A1* | 5/2012 | Wu | 336/192 |

FOREIGN PATENT DOCUMENTS

| | | | | |
|---|---|---|---|---|
| JP | 2001-160509 | A | | 6/2001 |
| JP | 2002-527538 | A | | 8/2002 |
| JP | 2003-151829 | A | | 5/2003 |
| JP | 2003151829 | A | * | 5/2003 |
| JP | 2005-109097 | A | | 4/2005 |
| JP | 2007-149757 | A | | 6/2007 |
| JP | 2007149757 | A | * | 6/2007 |
| JP | 2007-519219 | A | | 7/2007 |

(Continued)

*Primary Examiner* — Tsz Chan

(74) *Attorney, Agent, or Firm* — McDermott Will & Emery LLP

(57) ABSTRACT

Disclosed herein is a multilayer inductor, manufactured by stacking laminates each including: a substrate having internal electrode coil patterns formed thereon; and a magnetic substance filling the substrate on which the internal electrode coil patterns are formed, wherein the substrate is formed by using a composition including a magnetic material, so that, when the substrate is placed in the middle of the electrode circuit patterns at the time of manufacturing a power inductor, the substrate can be utilized as a gap material, and thus the thickness of an inductor chip can be minimized, and, in addition, the magnetic material is included in the substrate forming composition, thereby improving magnetic characteristics, and the liquid crystal oligomer and the nanoclay are added to the composition, to thereby increase insulating property between magnetic metals, thereby raising inductance, and thus dimensional stability and physical hardness of the structure can be secured.

21 Claims, 2 Drawing Sheets

(56) References Cited

FOREIGN PATENT DOCUMENTS

| | | | |
|---|---|---|---|
| JP | 2010-034102 | A | 2/2010 |
| JP | 2010-205905 | A | 9/2010 |
| KR | 10-2001-104611 | A | 11/2001 |
| KR | 10-2009-0033378 | A | 4/2009 |

* cited by examiner

MULTILAYER INDUCTOR AND METHOD FOR MANUFACTURING THE SAME

CROSS REFERENCE(S) TO RELATED APPLICATIONS

This application claims the benefit under 35 U.S.C. Section 119 of Korean Patent Application Serial No. 10-2012-0133666, entitled "Multilayer Inductor and Method for Manufacturing the Same" filed on Nov. 23, 2012, which is hereby incorporated by reference in its entirety into this application.

BACKGROUND OF THE INVENTION

1. Technical Field

The present invention relates to a multilayer inductor and a method for manufacturing the same.

2. Description of the Related Art

Devices have been increasingly required to have a smaller size and a slimmer thickness with the development of IT technology, and the demands of markets for smaller and thinner devices have increased. For this reason, materials and structures capable of improving inductance of a power inductor realizing high-inductance low-direct resistance are needed.

As for the existing chip inductor, several layers of laminates in which electrode patterns are formed in a lamination type are stacked, and wirings for the respective layers are connected through via holes.

The electrode patterns are formed on ferrite sheets by a printing process. The laminates of the thus formed ferrite+ electrode sheets are stacked, and interlayer connection is performed through the via holes.

RELATED ART DOCUMENT

Patent Document (Patent Document 1) Japanese Patent Laid-Open Publication No. 2005-109097

SUMMARY OF THE INVENTION

The present invention was completed based on the fact that, when a substrate is inserted in the middle of internal circuit patters to form a multilayer inductor, the substrate is utilizable as a gap material, thereby lowering the thickness of a chip, and the loss of saturation current due to the inserted substrate can be minimized by including a magnetic material.

Therefore, an object of the present invention is to provide a multilayer inductor capable of minimizing the thickness of a chip and improving magnetic characteristics by placing a substrate of the multilayer inductor in the middle of internal circuit patterns and including a magnetic material in the substrate.

Further, an object of the present invention is to provide a multilayer inductor capable of increasing insulating property between magnetic materials and thus raising inductance thereof, by applying, as a magnetic layer, an insulation composition of a printed circuit board as well as a magnetic material and a composite of polymer.

Further, another object of the present invention is to provide a magnetic composition used in a general substrate or a substrate of a multilayer inductor and a magnetic layer.

Further, still another object of the present invention is to provide a method for manufacturing a multilayer inductor.

According to an exemplary embodiment of the present invention, there is provided a multilayer inductor, manufactured by stacking laminates each including: a substrate having internal electrode coil patterns formed thereon; and a magnetic substance filling the substrate on which the internal electrode coil patterns are formed, wherein the substrate is formed by using a composition including a magnetic material.

The internal electrode coil patterns may be included on both surfaces of the substrate, to thereby be placed in the middle of the internal electrode coil patterns.

The magnetic material may be selected from a metal exhibiting soft magnetism, having a diameter of 0.05~20 μm, and a metal-polymer composite exhibiting soft magnetism.

The metal-polymer composite may have a type where the metal exhibiting soft magnetism is dispersed in the polymer.

Here, a polymer of the metal-polymer composite may be at least one selected from the group consisting of an epoxy resin, a phenoxy resin, a polyimide resin, a polyamideimide (PAI) resin, a polyetherimide (PEI) resin, a polysulfone (PS) resin, a polyethersulfone (PES) resin, a polyphenyleneether (PPE) resin, a polycarbonate (PC) resin, a polyetheretherketone (PEEK) resin, and a polyester resin.

The composition may include a liquid crystal oligomer, an epoxy resin, and nanoclay.

The liquid crystal oligomer may contain hydroxy groups and nadimide groups at ends thereof.

The nanoclay may be montmorillonite surface-treated with a positive ion or montmorillonite surface-treated with quaternary ammonium salt to which C6-C18 aliphatic hydrocarbon or alkyl is added.

The epoxy resin may be one or two or more selected from multifunctional epoxy resins including two or more epoxy groups in one molecule thereof.

The composition may include 5~50 wt % of a liquid crystal oligomer; 5~50 wt % of an epoxy resin; 0.5~10 wt % of nanoclay; and 50~80 wt % of a magnetic material.

The substrate may have a composite structure in which a reinforcement member is impregnated with the composition.

The reinforcement member may be at least one selected from the group consisting of woven glass cloth, woven alumina glass fiber, glass fiber non-woven fabric, cellulose non-woven fabric, woven carbon fiber, polymer cloth, glass fiber, silica glass fiber, carbon fiber, alumina fiber, silicon carbide fiber, asbestos, rock wool, mineral wool, gypsum whisker, woven fabrics or non-woven fabric thereof, aromatic polyamide fiber, polyimide fiber, liquid crystal polyester, polyester fiber, fluoride fiber, polybenzoxazole fiber, glass fiber having polyamide fiber, glass fiber having carbon fiber, glass fiber having polyimide fiber, glass fiber having aromatic polyester, glass paper, mica paper, alumina paper, Kraft paper, cotton paper, and paper combined with paper-glass.

The multilayer inductor may further include insulating layers insulating the laminates from each other.

The insulating layer may be formed by using a composition including a liquid crystal oligomer, an epoxy resin, nanoclay, and an inorganic filler.

The inorganic filler may be at least one selected from the group consisting of natural silica, fused silica, amorphous silica, hollow silica, aluminum hydroxide, boehmite, magnesium hydroxide, molybdenum oxide, zinc molybdate, zinc borate, zinc stannate, aluminum borate, potassium titanate, magnesium sulfate, silicon carbide, zinc oxide, boron nitride (BN), silicon nitride, silicon oxide, aluminum titanate, barium titanate, barium strontium titanate, aluminum oxide, alumina, clay, kaolin, talc, calcined clay, calcined kaolin, calcined talc, mica, glass short fiber, and a mixture thereof.

The insulating layer may include 0.5~10 wt % of nanoclay; 5~50 wt % of a liquid crystal oligomer; 5~50 wt % of an epoxy resin; and 50~80 wt % of an inorganic filler.

According to another exemplary embodiment of the present invention, there is provided a magnetic substance composition including: 0.5~10 wt % of nanoclay; 5~50 wt % of a liquid crystal oligomer; 5~50 wt % of an epoxy resin; and 50~80 wt % of a magnetic metal powder.

The magnetic metal powder may be a metal exhibiting soft magnetism, having a diameter of 0.05~20 μm.

The magnetic substance composition may be used for a substrate.

The magnetic substance composition may be used for a substrate of an inductor or a magnetic layer.

According to still another exemplary embodiment of the present invention, there is provided a method for manufacturing a multilayer inductor, the method including: forming electrode circuit patterns on each of substrates; filling each of substrates on which the electrode circuit pattern are formed with a magnetic substance, to thereby manufacture laminates; and stacking the laminates, wherein the substrates are formed by using a composition including a magnetic material.

The method may further include, at the time of stacking the laminates, forming insulating layers each between the laminates.

DESCRIPTION OF THE PREFERRED EMBODIMENTS

Hereinafter, the present invention will be described in detail.

Terms used in the present specification are for explaining the embodiments rather than limiting the present invention. As used herein, unless explicitly described to the contrary, a singular form includes a plural form in the present specification. Also, used herein, the word "comprise" and/or "comprising" will be understood to imply the inclusion of stated constituents, steps, operations and/or elements but not the exclusion of any other constituents, steps, operations and/or elements.

The present invention is directed to a multilayer inductor having a minimized chip thickness and excellent inductance.

Figure 1:
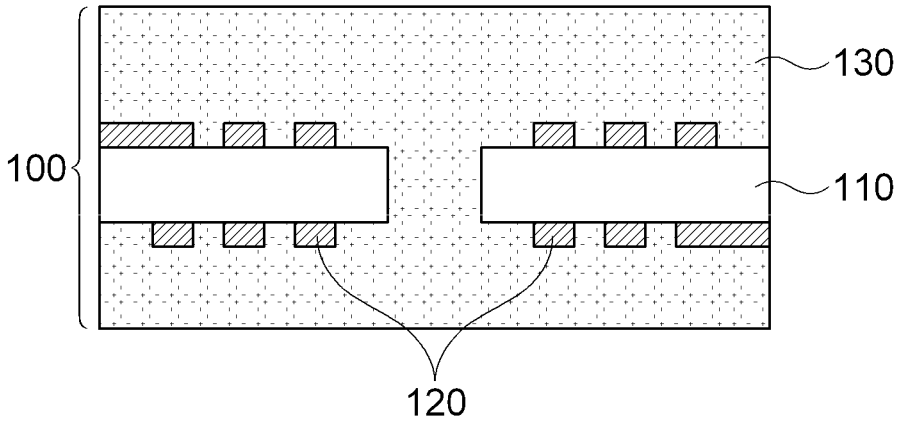
FIGS. 1 to 3 show structures of multilayer inductors according to exemplary embodiments of the present invention.

A multilayer inductor according to the present invention has a structure shown in FIG. 1. Referring to FIG. 1, the multilayer inductor is manufactured by stacking laminates 100 each including a substrate 110, electrode circuit patterns 120 formed on both surfaces of the substrate, and a magnetic substance 130 filling the substrate on which the electrode circuit patterns 120 are formed. The substrate 110 is characterized by including a magnetic material.

In the present invention, the substrate 110 of the multilayer inductor is placed in the middle of the electrode circuit patterns 120 while the substrate 110 may be formed by using a composition containing a magnetic material. This structure can maintain or improve functions of the substrate and magnetic characteristics thereof inside the inductor at the time of processing.

The magnetic material may contain metal having a diameter of 0.05~20 μm, exhibiting soft magnetism, or a composite type of metal exhibiting soft magnetism and polymer.

In the exemplary embodiment of the present invention, in the magnetic material, the metal exhibiting soft magnetism is preferably ferrite containing magnesium (Mg) or nickel (Ni), and optionally containing zinc (Zn).

The metal exhibiting soft magnetism has a diameter of preferably 0.05~20 μm in view of reducing core loss and raising filling density.

In the exemplary embodiment of the present invention, in the case where the magnetic material is a composite of a metal exhibiting soft magnetism and a polymer, the metal exhibiting soft magnetism preferably has a type where the metal is dispersed in the polymer. The polymer used at this time may be at least one selected from the group consisting of an epoxy resin, a phenoxy resin, a polyimide resin, a polyamideimide (PAI) resin, a polyetherimide (PEI) resin, a polysulfone (PS) resin, a polyethersulfone (PES) resin, a polyphenyleneether (PPE) resin, a polycarbonate (PC) resin, a polyetheretherketone (PEEK) resin, and a polyester resin, and of these, the epoxy resin is most preferable. In addition, in the case where the magnetic material is the composite of metal exhibiting soft magnetism and polymer, it is preferable to disperse 50~80 wt % of the metal exhibiting soft magnetism in the polymer.

The content of the magnetic material according to the present invention is preferably included in a content of 50~80 wt % based on a substrate forming composition. If the content of the magnetic material is below 50 wt %, sufficient permeability may not be obtained, and thus this content is not preferable in realizing inductance characteristics. If above 80 wt %, dispersibility may be deteriorated, and thus this content is not preferable in securing processability for manufacturing products.

In the present invention, the substrate 110 is formed by using the substrate forming composition including a liquid crystal oligomer, an epoxy resin, and nanoclay, together with the magnetic material.

The liquid crystal oligomer preferably contains hydroxy groups and nadimide groups at ends thereof. The functional groups may react with the epoxy resin or functional groups combined on a surface of the nanoclay.

An example of the liquid crystal oligomer according to the present invention may be represented by Chemical Formula 1 or Chemical Formula 2. In Chemical Formulas 1 and 2, a, b, c, d, and e mean mole ratios of repetitive units, which are determined depending on the content of a starting material.

[Chemical Formula 1]

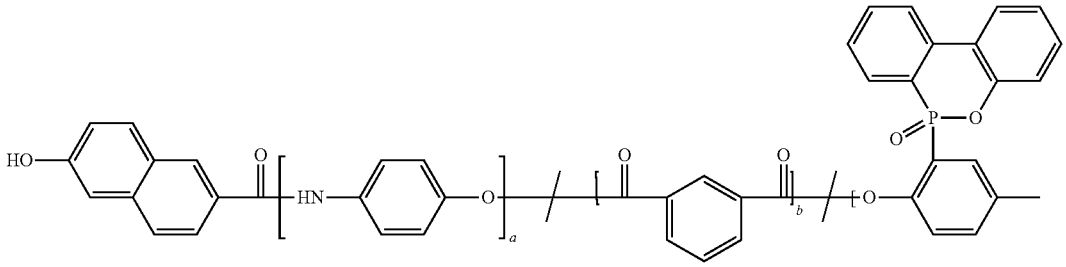

-continued

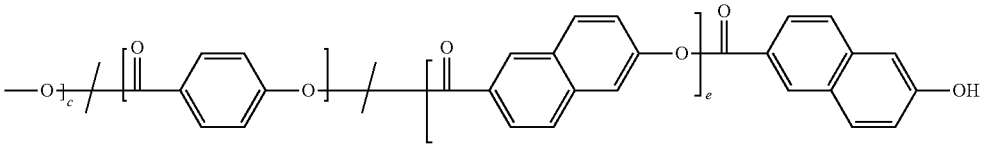

[Chemical Formula 2]

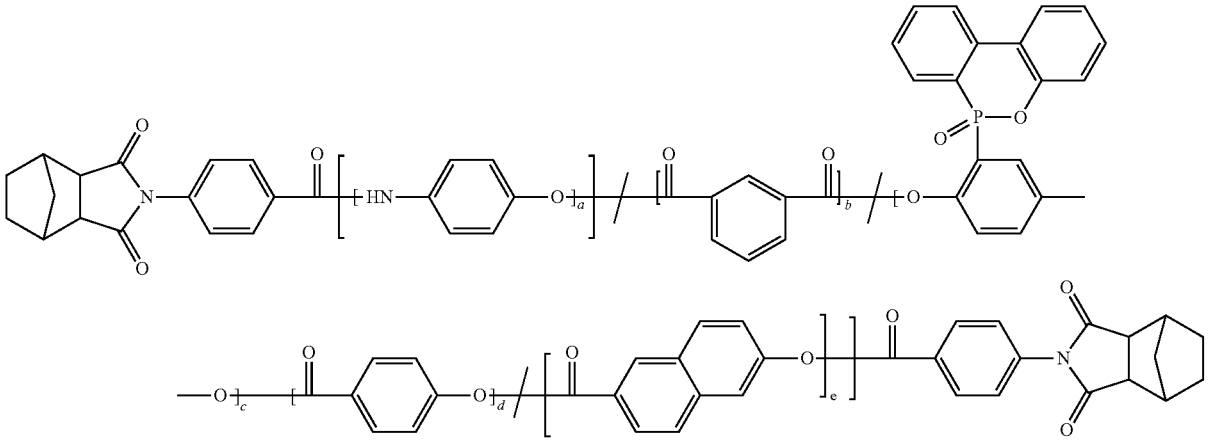

The liquid crystal oligomer according to the present invention has a number average molecular weight of preferably 3000~5000 g/mol in view of exhibiting appropriate cross-linking density, securing heat resistance, and showing excellent solubility to a solvent.

In addition, the content of the liquid crystal oligomer according to the present invention is preferably included in a content of 5~50 wt % based on the substrate forming composition. If the content thereof is below 5 wt %, thermal characteristics may be deteriorated, such as, the coefficient of thermal expansion increases. If above 50 wt %, chemical resistance may be deteriorated, and thus this content is not preferable.

The epoxy resin included in the substrate forming composition of the present invention is preferably a multi-functional epoxy resin including two or more epoxy groups in one molecule thereof. Specific examples of the multi-functional epoxy resin may be phenolic glycidyl ether type epoxy resins, such as, a phenol novolac type epoxy resin, a cresol novolac type epoxy resin, a naphthol modified novolac-type epoxy resin, a bisphenol A type epoxy resin, a bisphenol F-type epoxy resin, a biphenyl type epoxy resin, or a triphenyl-type epoxy resin; dicyclopentadiene type epoxy resins having a dicyclopentadiene skeleton; naphthalene type epoxy resins having a naphthalene skeleton; dihydroxy benzopyran type epoxy resins; glycidyl amine type epoxy resins using polyamine such as diaminophenyl methane as a raw material; triphenol methane type epoxy resins; tetraphenyl ethane type epoxy resins; or a mixture thereof. Of these, the naphthalene type epoxy resins having a naphthalene skeleton or aromatic amine type epoxy resins are preferable.

The content of the epoxy resin according to the present invention is preferably included in a content of 5~50 wt % based on the substrate forming composition. In the case where the epoxy resin is included within the above range, this content is preferable in view of maintaining peel strength and improving heat stability.

In addition, the substrate forming composition of the present invention particularly includes a magnetic material. The magnetic material has high density, and thus it may not be easily dispersed in the substrate forming composition. Therefore, it is preferable to add nanoclay as a thickener, in order to control viscosity of the composition so that the magnetic material is not precipitated in the substrate forming composition but well dispersed.

Besides the above purposes, the nanoclay has effects of lowering the coefficient of thermal expansion by forming a composite together with a resin polymer such as a liquid crystal oligomer, an epoxy resin, or the like, and enhancing strength of the substrate, such as high glass transition temperature or high modulus.

As the nanoclay according to the present invention, montmorillonite surface-treated with a positive ion or montmorillonite surface-treated with quaternary ammonium salt to which C6-C18 aliphatic hydrocarbon or alkyl is added may be preferably used.

The content of the nanoclay according to the present invention is preferably included in a content of 0.5~10 wt % based on the substrate forming composition. If the content thereof is below 0.5 wt %, mechanical characteristics and thermal characteristics may be less improved. If above 10 wt %, dispersibility may be deteriorated, and thus this content is not preferable.

The nanoclay according to the present invention includes from a type where it is completely cleavable-dispersed into a plate type having a thickness of several nanometers (nm) depending on the dispersion characteristics thereof and then mixed with LCO or an epoxy resin, to a type where it is less cleavable-dispersed to have a thickness of several tens or several hundreds nanometers or micrometers and then combined with the LCO or epoxy resin to form a composite.

Here, "cleavable dispersion" of the nanoclay means that the nanoclay is dispersed while a plate shape thereof is maintained as it is. In addition, the expression "completely cleavable-dispersed" means that the nanoclay according to the present invention is dispersed to a size smaller than an original size thereof while an original shape thereof, a plate shape, is maintained. That is, the nanoclay is a material having a multilayer structure in which a sum of one layer thickness (9.6 Å) and an interlayer distance is called d-spacing or basal spacing. The d-spacing or basal spacing is a repetitive unit of this material, which may be calculated from (001) harmonics of the X-ray diffraction pattern. In the case of montmorillonite, which is an example of the nanoclay according to the present invention, if the thickness thereof is 9.6 Å-200 Å, it may mean that it is completely cleavable-dispersed.

The substrate forming composition according to the present invention may further include, in addition to the above composition, a thermal plastic resin in order to improve processability of the film, and further include a rubber in order to improve processability.

Besides, the substrate forming composition may further include other hardeners, a hardening promoter, a leveling agent, a flame retardant, and the like, as necessary, as long as the targeting physical properties are not deteriorated.

In the present invention, a sheet type substrate 110 may be manufactured by using the above composition through a method such as casting or the like.

Figure 2:
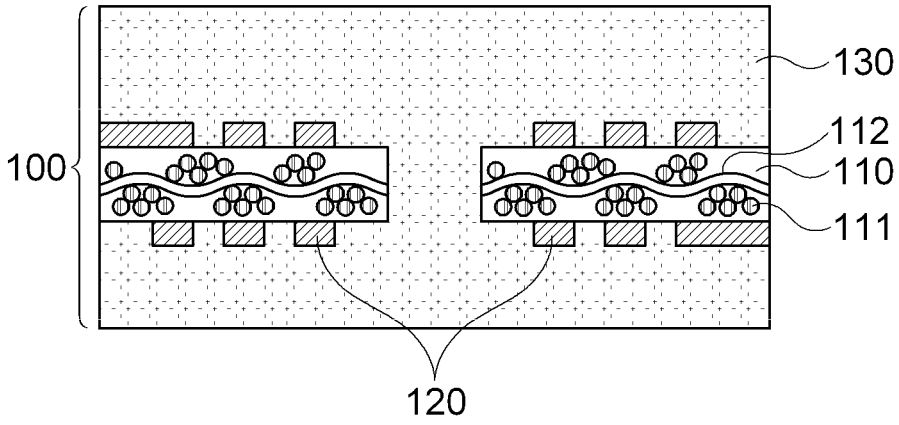

In addition, according to the exemplary embodiment of the present invention, the substrate 110 may have a composite structure in which a reinforcement member is impregnated with the substrate forming composition. Then, as shown in FIG. 2, the substrate 110 has a structure in which the reinforcement member 112 is impregnated with the substrate forming composition, and the magnetic material 111 of the substrate forming composition may be uniformly dispersed.

The reinforcement member may be variously selected depending on the thicknesses of the structure materials and the amounts of the magnetic material and the resins (the liquid crystal oligomer, the epoxy resin, and the like). Specific examples thereof may be woven glass cloth, woven alumina glass fiber, glass fiber non-woven fabric, cellulose non-woven fabric, woven carbon fiber, polymer cloth, and the like. In addition, at least one selected from the group consisting of glass fiber, silica glass fiber, carbon fiber, alumina fiber, silicon carbide fiber, asbestos, rock wool, mineral wool, gypsum whisker, woven fabrics or non-woven fabric thereof, aromatic polyamide fiber, polyimide fiber, liquid crystal polyester, polyester fiber, fluoride fiber, polybenzoxazole fiber, glass fiber having polyamide fiber, glass fiber having carbon fiber, glass fiber having polyimide fiber, glass fiber having aromatic polyester, glass paper, mica paper, alumina paper, Kraft paper, cotton paper, and paper combined with paper-glass. Of these, woven glass fibers using E-glass, T-glass, S-glass, and L-glass as yarn are most preferable.

In addition, the present invention may provide a magnetic substance composition including 0.5~10 wt % of nanoclay; 5~50 wt % of liquid crystal oligomer; 5~50 wt % of epoxy resin; and 50~80 wt % of magnetic metal powder.

In addition, the nanoclay, liquid crystal oligomer, epoxy resin are as described above, while the magnetic metal powder may be metal exhibiting soft magnetism, having a diameter of 0.05~20 μm.

According to the exemplary embodiment of the present invention, the magnetic substance composition may be used for a substrate.

According to the exemplary embodiment of the present invention, the magnetic substance composition may be used for a substrate of an inductor or a magnetic layer.

In the multilayer inductor according to the present invention, a through hole is formed in the substrate formed of the substrate forming composition, the through hole having a diameter of two times or less the thickness of the internal coil pattern 120, and the through hole is filled with metal to form the electrode coil patterns 120 on both surfaces of the substrate 110. The electrode coil pattern 120 may be formed by using Cu of which electric conductivity is low and a coil forming process is stabilized.

The electrode coil pattern 120 according to the present invention may be configured in a single layer type or a multilayer type of spiral shape, and is formed in two directions of a quadrant symmetrical in order to be connected with the external electrodes (not shown), as shown in FIG. 1.

In addition, the multilayer inductor of the present invention may be manufactured by filling the substrate on which the electrode circuit pattern 120 is formed with the magnetic substance 130, to form each laminate 100, and connecting a plurality of laminates 100 with each other. The electrode circuit patterns 120 may be connected to each other through a via hole formed in the substrate 110.

As the magnetic substance 130, the foregoing soft magnetic metal powder may be used alone. Alternatively, the magnetic substance 130 may be at least one selected from a magnetic metal-polymer composite type in which the magnetic metal powder is dispersed in a composition including a polymer resin and a solvent and a type in which the magnetic metal powder is dispersed in a composition including a liquid crystal oligomer, an epoxy resin, and nanoclay.

The polymer used for dispersing the magnetic metal powder may be at least one selected from the group consisting of an epoxy resin, a phenoxy resin, a polyimide resin, a polyamideimide (PAI) resin, a polyetherimide (PEI) resin, a polysulfone (PS) resin, a polyethersulfone (PES) resin, a polyphenyleneether (PPE) resin, a polycarbonate (PC) resin, a polyetheretherketone (PEEK) resin, and a polyester resin, and of these, the epoxy resin is most preferable.

In addition, the magnetic substance 130 according to the present invention may be used by dispersing the magnetic metal powder in a substrate forming composition including the liquid crystal oligomer, epoxy resin, and nanoclay.

The number of stacked laminates 100 is not particularly limited, and may be appropriately selected depending on the thickness of a structure requested.

According to the exemplary embodiment of the present invention, the laminates 100 are connected through the via holes, to thereby manufacture a multilayer inductor.

Figure 3:
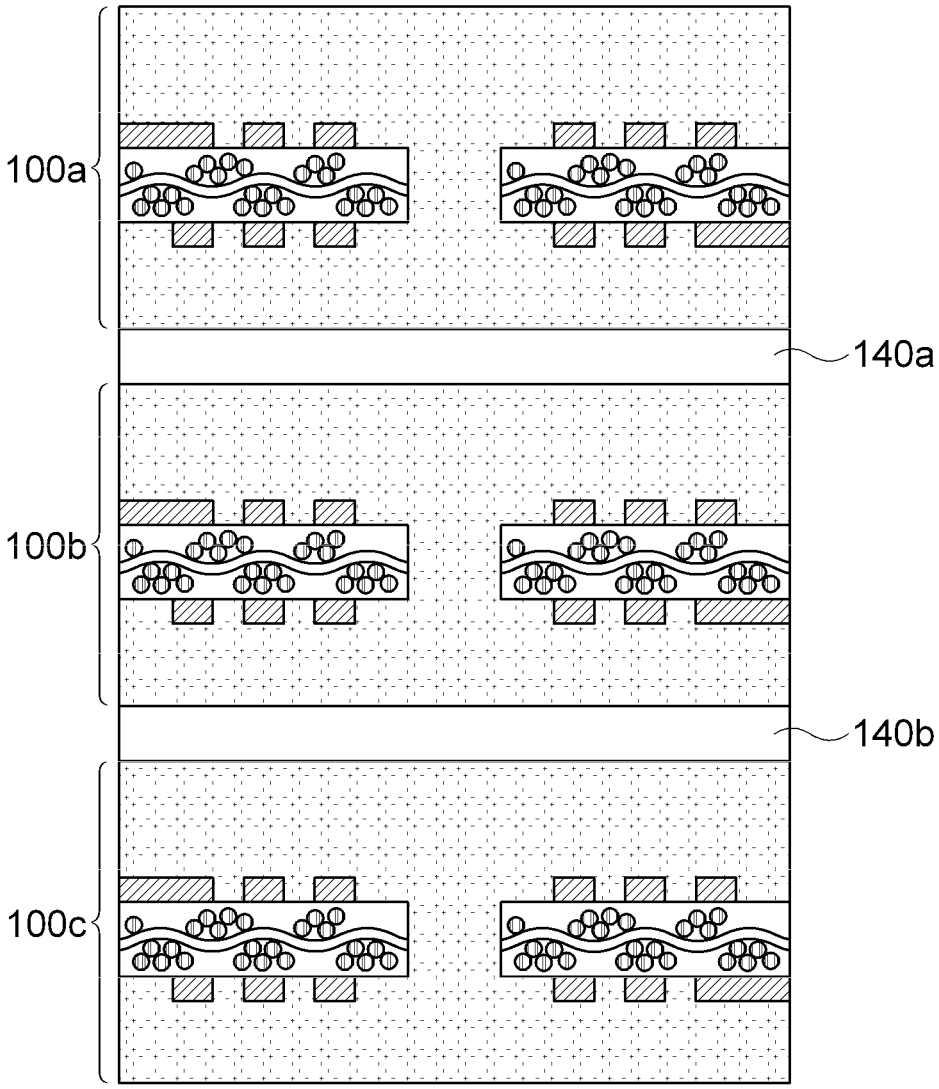

In addition, according to another exemplary embodiment of the present invention, the laminates 100 are connected through the via holes, and here, as shown in FIG. 3, insulating layers 140*a*, 140*b*, and 140*c* may be disposed between the laminates 100*a*, 100*b*, and 100*c*.

The insulating layers 140*a*, 140*b*, and 140*c* may be formed by using a composition including a liquid crystal oligomer, an epoxy resin, nanoclay, and an inorganic filler.

The liquid crystal oligomer, the epoxy resin, and the nanoclay are the same kinds and have the same contents, as those of the substrate forming composition described above in detail.

However, the insulating layers 140*a*, 140*b*, and 140*c* are preferably formed by using an inorganic filler instead of the magnetic material of the substrate forming composition, for insulating characteristics.

The inorganic filler may be at least one selected from the group consisting of natural silica, fused silica, amorphous silica, hollow silica, aluminum hydroxide, boehmite, magnesium hydroxide, molybdenum oxide, zinc molybdate, zinc borate, zinc stannate, aluminum borate, potassium titanate, magnesium sulfate, silicon carbide, zinc oxide, boron nitride (BN), silicon nitride, silicon oxide, aluminum titanate, barium titanate, barium strontium titanate, aluminum oxide, alumina, clay, kaolin, talc, calcined clay, calcined kaolin, calcined talc, mica, glass short fiber, and a mixture thereof.

The inorganic filler is preferably included in a content of 50~80 wt % based on the composition of the insulating layer. If the content of the inorganic filler is below 50 wt %, the coefficient of thermal expansion may be too high, and thus this content is not preferable. If above 80 wt %, adhesive strength may be deteriorated, and thus this content is not preferable.

Example

A multilayer inductor having a structure as shown in FIG. 2 was manufactured. First, 291.67 g of NiZn ferrite exhibiting soft magnetism, having a diameter of 5~15 μm, 0.75 g (1 wt % of LCO+epoxy) of nanoclay (Nanofil 116, montmorillonite surface-treated with a positive ion were added to 125 g of DMAc, and then stirred for 1 hour by using a high-speed stirrer. 150 g of an LCO solution (Mn=3000~5000, solid content of LCO (compound represented by Chemical Formula 1), which is dissolved in the solvent DMAc, is 50 wt %) was added to the stirred solution, and then stirred for 1 hour. Last, 50 g of epoxy resin (MY-721, Huntsman) and 0.5 g of hardener (DICY) were added thereto, and then stirred for 2 hours, to prepare a substrate forming composition. Three kinds of woven glass fibers as shown in Table 1 were impregnated with the substrate forming composition, to manufacture a glass fiber structure, which was then used for a substrate.

A multilayer inductor was manufactured by forming spiral shaped internal electrode circuit patterns on both surfaces of the substrate in two directions of quadrant symmetrical, filling the substrate on which the electrode circuit patterns are formed with a magnetic substance to manufacture each laminate, and then stacking a plurality of laminates.

Experimental Example

Inductances of the manufactured glass fiber structure and a multilayer inductor using the glass fiber structure as a substrate were measured, and the measurement results were tabulated in Table 1. The following inductance means a relative value based on a woven glass fiber having a thickness of 60 μm (a product on the market).

TABLE 1

| | Thickness of woven glass fiber (μm) | | |
|---|---|---|---|
| | 100 | 60 | 40 |
| Inductance of glass fiber structure (Ls, Ur] | −6.81 | 0.00 | 3.91 |
| Inductance of multilayer inductor [Ur] | 0.93 | 1.00 | 1.04 |

As seen from the results of Table 1 above, it was measured that, in the case where the magnetic material is included in the substrate like the present invention, magnetic characteristics were improved and inductance was increased for the glass fiber structure and the inductor even though the thickness of the glass fiber structure in the chip was decreased.

As set forth above, according to the present invention, when the substrate is placed in the middle of the electrode circuit patterns at the time of manufacturing a power inductor, the substrate can be utilized as a gap material, and thus the thickness of an inductor chip can be minimized.

Further, the magnetic material is included in the substrate forming composition, thereby improving magnetic characteristics, and the liquid crystal oligomer and the nanoclay are added to the composition, to thereby increase insulating property between magnetic metals, thereby raising inductance, and thus dimensional stability and physical hardness of the structure can be secured.

What is claimed is:

1. A multilayer inductor, manufactured by stacking laminates each comprising:

a substrate having internal electrode coil patterns formed thereon; and a magnetic substance filling the substrate on which the internal electrode coil patterns are formed, wherein the substrate is formed by using a composition including a magnetic material, and the composition includes a liquid crystal oligomer, an epoxy resin, and nanoclay.

2. The multilayer inductor according to claim 1, wherein the internal electrode coil patterns are included on both surfaces of the substrate, to thereby be placed in the middle of the internal electrode coil patterns.

3. The multilayer inductor according to claim 1, wherein the magnetic material is selected from a metal exhibiting soft magnetism, having a diameter between 0.05 and 20 μm, inclusive, and a metal-polymer composite exhibiting soft magnetism.

4. The multilayer inductor according to claim 3, wherein the metal-polymer composite has a type where the metal exhibiting soft magnetism is dispersed in the polymer.

5. The multilayer inductor according to claim 3, wherein a polymer of the metal-polymer composite is at least one selected from the group consisting of an epoxy resin, a phenoxy resin, a polyimide resin, a polyamideimide (PAI) resin, a polyetherimide (PEI) resin, a polysulfone (PS) resin, a polyethersulfone (PES) resin, a polyphenyleneether (PPE) resin, a polycarbonate (PC) resin, a polyetheretherketone (PEEK) resin, and a polyester resin.

6. The multilayer inductor according to claim 1, wherein the liquid crystal oligomer contains hydroxy groups and nadimide groups at ends thereof.

7. The multilayer inductor according to claim 1, wherein the nanoclay is montmorillonite surface-treated with a positive ion or montmorillonite surface-treated with quaternary ammonium salt to which C6-C18 aliphatic hydrocarbon or alkyl is added.

8. The multilayer inductor according to claim 1, wherein the epoxy resin is one or two or more selected from multifunctional epoxy resins including two or more epoxy groups in one molecule thereof.

9. The multilayer inductor according to claim 1, wherein the composition includes between 5 and 50 wt %, inclusive, of a liquid crystal oligomer; between 5 and 50 wt %, inclusive, of an epoxy resin; between 0.5 and 10 wt %, inclusive, of nanoclay; and between 50 and 80 wt %, inclusive, of a magnetic material.

10. The multilayer inductor according to claim 1, wherein the substrate has a composite structure in which a reinforcement member is impregnated with the composition.

11. The multilayer inductor according to claim 10, wherein the reinforcement member is at least one selected from the group consisting of woven glass cloth, woven alumina glass fiber, glass fiber non-woven fabric, cellulose non-woven fabric, woven carbon fiber, polymer cloth, glass fiber, silica glass fiber, carbon fiber, alumina fiber, silicon carbide fiber, asbestos, rock wool, mineral wool, gypsum whisker, woven fabrics or non-woven fabric thereof, aromatic polyamide fiber, polyimide fiber, liquid crystal polyester, polyester fiber, fluoride fiber, polybenzoxazole fiber, glass fiber having polyamide fiber, glass fiber having carbon fiber, glass fiber having polyimide fiber, glass fiber having aromatic polyester, glass paper, mica paper, alumina paper, Kraft paper, cotton paper, and paper combined with paper-glass.

12. The multilayer inductor according to claim 1, further comprising insulating layers insulating the laminates from each other.

13. The multilayer inductor according to claim 12, wherein the insulating layer is formed by using a composition including a liquid crystal oligomer, an epoxy resin, nanoclay, and an inorganic filler.

14. The multilayer inductor according to claim 13, wherein the inorganic filler is at least one selected from the group consisting of natural silica, fused silica, amorphous silica, hollow silica, aluminum hydroxide, boehmite, magnesium hydroxide, molybdenum oxide, zinc molybdate, zinc borate, zinc stannate, aluminum borate, potassium titanate, magnesium sulfate, silicon carbide, zinc oxide, boron nitride (BN), silicon nitride, silicon oxide, aluminum titanate, barium titanate, barium strontium titanate, aluminum oxide, alumina, clay, kaolin, talc, calcined clay, calcined kaolin, calcined talc, mica, glass short fiber, and a mixture thereof.

15. The multilayer inductor according to claim 12, wherein the insulating layer includes between 0.5 and 10 wt %, inclusive, of nanoclay; between 5 and 50 wt %, inclusive, of a liquid crystal oligomer; between 5 and 50 wt %, inclusive, of an epoxy resin; and between 50 and 80 wt %, inclusive, of an inorganic filler.

16. A magnetic substance composition comprising: between 0.5 and 10 wt %, inclusive, of nanoclay; between 5 and 50 wt %, inclusive, of a liquid crystal oligomer; between 5 and 50 wt %, inclusive, of an epoxy resin; and between 50 and 80 wt %, inclusive, of a magnetic metal powder.

17. The magnetic substance composition according to claim 16, wherein the magnetic metal powder is a metal exhibiting soft magnetism, having a diameter between 0.05 and 20 μm, inclusive.

18. The magnetic substance composition according to claim 16, wherein the magnetic substance composition is used for a substrate.

19. The magnetic substance composition according to claim 16, wherein the magnetic substance composition is used for a substrate of an inductor or a magnetic layer.

20. A method for manufacturing a multilayer inductor, the method comprising:

forming electrode circuit patterns on each of substrates;

filling each of substrates on which the electrode circuit patterns are formed with a magnetic substance, to thereby manufacture laminates; and stacking the laminates, wherein the substrates are formed by using a composition including a magnetic material, and the composition includes a liquid crystal oligomer, an epoxy resin, and nanoclay.

21. The method according to claim 20, further comprising, at the time of stacking the laminates, forming insulating layers each between the laminates.

* * * * *